US010926313B2

(12) United States Patent
Ishizuka et al.

(10) Patent No.: US 10,926,313 B2
(45) Date of Patent: Feb. 23, 2021

(54) FORMING APPARATUS

(71) Applicant: SUMITOMO HEAVY INDUSTRIES, LTD., Tokyo (JP)

(72) Inventors: Masayuki Ishizuka, Ehime (JP); Norieda Ueno, Tokyo (JP); Masayuki Saika, Ehime (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 154 days.

(21) Appl. No.: 15/829,380

(22) Filed: Dec. 1, 2017

(65) Prior Publication Data

US 2018/0078988 A1 Mar. 22, 2018

Related U.S. Application Data

(63) Continuation of application No. PCT/JP2016/066045, filed on May 31, 2016.

(30) Foreign Application Priority Data

Jun. 2, 2015 (JP) ..... JP2015-112095

(51) Int. Cl.
*B21D 26/00* (2006.01)
*B21D 26/047* (2011.01)
(Continued)

(52) U.S. Cl.
CPC ..... *B21D 26/047* (2013.01); *B21D 15/03* (2013.01); *B21D 26/033* (2013.01);
(Continued)

(58) Field of Classification Search
CPC .. B21D 26/003; B21D 26/039; B21D 26/047; B21D 26/035; B21D 37/10;
(Continued)

(56) References Cited

U.S. PATENT DOCUMENTS 6,237,382 B1 * 5/2001 Kojima ..... B21D 22/025 29/421.1
6,322,645 B1 * 11/2001 Dykstra ..... A61F 13/15203 148/520
(Continued)

FOREIGN PATENT DOCUMENTS

CA 2544242 A1 * 5/2005 ..... B21D 26/035
DE 19610367 A1 * 4/1997 ..... B21D 26/039
(Continued)

OTHER PUBLICATIONS

NPTEL, Module 6: Pneumatic Systems, Apr. 20, 2014 (per archive.org), https://nptel.ac.in/courses/112103174/pdf/mod6.pdf (Year: 2014).*
(Continued)

*Primary Examiner* — Adam J Eiseman
*Assistant Examiner* — Bobby Yeonjin Kim
(74) *Attorney, Agent, or Firm* — Michael Best & Friedrich LLP

(57) ABSTRACT

A forming apparatus includes: an upper die and a lower die having forming surfaces corresponding to outer surfaces of a pipe with protrusions; a moving mechanism that moves the upper die and the lower die such that a forming space for forming the pipe with protrusions is defined between the forming surfaces of the upper die and the lower die; and a gas supply unit that supplies gas to a forming material to expand the forming material. A control unit controls the movement of the upper die and the lower die by the moving mechanism and the supply of gas to the forming material by the gas supply unit such that the forming material is formed into the pipe with protrusions in the forming space.

15 Claims, 12 Drawing Sheets

(51) Int. Cl.

| | |
|---|---|
| ***B21D 26/033*** | (2011.01) |
| ***B21D 15/03*** | (2006.01) |
| ***B21D 26/041*** | (2011.01) |
| ***B21D 26/039*** | (2011.01) |
| ***B21D 26/043*** | (2011.01) |

(52) U.S. Cl.
CPC ..... *B21D 26/039* (2013.01); *B21D 26/041* (2013.01); *B21D 26/043* (2013.01)

(58) Field of Classification Search
CPC .. B21D 26/033; B21D 26/045; B21D 26/041; B21J 7/18; B30B 1/007; B30B 1/32
USPC ..... 72/61, 381, 383, 60, 62, 57; 29/421.1
See application file for complete search history.

(56) References Cited

U.S. PATENT DOCUMENTS

| | | | | |
|---|---|---|---|---|
| 6,530,252 | B1 * | 3/2003 | Hashimoto | B21D 26/025 29/421.1 |
| 8,408,034 | B2 * | 4/2013 | Ishihara | B21D 26/047 72/58 |
| 10,329,668 | B2 * | 6/2019 | Franken | C23C 18/1691 |
| 2003/0151273 | A1 * | 8/2003 | Sakamoto | B62D 29/007 296/187.01 |
| 2005/0186302 | A1 * | 8/2005 | Sohn | B21D 26/033 425/392 |
| 2007/0277574 | A1 * | 12/2007 | Schroeder | B21D 26/045 72/61 |
| 2008/0011382 | A1 * | 1/2008 | Tomizawa | B21D 26/045 138/177 |
| 2009/0044592 | A1 * | 2/2009 | Shikano | B21D 25/00 72/382 |
| 2017/0120317 | A1 * | 5/2017 | Ishizuka | B21D 26/035 |

FOREIGN PATENT DOCUMENTS

| | | | | |
|---|---|---|---|---|
| JP | H07-080925 | A | 3/1995 | |
| JP | H11-333526 | A | 12/1999 | |
| JP | 2000-246361 | A | 9/2000 | |
| JP | 2004-114113 | A | 4/2004 | |
| JP | 2006-061944 | A | 3/2006 | |
| JP | 2001-259754 | A | 9/2010 | |
| JP | 2012-000654 | A | 1/2012 | |
| JP | 2012-040604 | A | 3/2012 | |
| WO | WO-02076809 | A1 * | 10/2002 | B21C 1/22 |

OTHER PUBLICATIONS

Hydraulic Circuit Design, Hydraulic Systems Components, Jan. 24, 2013 (per archive.org), https://www.valvehydraulic.info/hydraulic-circuit-design/hydraulic-systems-components.html (Year: 2013).*

Espacenet.com, DE 19610367 A1 description machine translation (Year: 1997).*

Supplementary Search Report issued in European Application No. 16803340.5, dated May 4, 2018.

International Search Report issued in Application No. PCT/JP/2016/066045, dated Aug. 2, 2016.

* cited by examiner

FORMING APPARATUS

RELATED APPLICATIONS

This is a continuation of PCT/JP2016/066045 filed on May 31, 2016 claiming priority to Japanese Patent Application No. 2015-112095 filed on Jun. 2, 2015, the entire contents of each of which are incorporated herein by reference.

BACKGROUND

Technical Field

A certain embodiment of the present invention relates to a forming apparatus.

Description of Related Art

As a forming apparatus of the related art, an extrusion apparatus for extruding an extruded profile is known (refer to, for example, the related art). The extruded profile extruded by such an extrusion apparatus is an extruded profile with a flange having a square tubular main body portion and a flange protruding outward from a corner portion of the main body portion.

SUMMARY

According to an embodiment of the present invention, there is provided a forming apparatus that forms a pipe with protrusions having a tubular pipe main body and protrusions protruding outward from an outer surface of the pipe main body and extending in a direction parallel to an axis of the pipe main body, the forming apparatus including: a plurality of dies composed of at least three dies having forming surfaces corresponding to outer surfaces of the pipe with protrusions; a moving mechanism that moves the plurality of dies such that a forming space for forming the pipe with protrusions is defined between the forming surfaces of the plurality of dies; a gas supply unit that supplies gas to a forming material which is a base of the pipe with protrusions to expand the forming material; and a control unit that controls movement of the plurality of dies by the moving mechanism and gas supply to the forming material by the gas supply unit such that the forming material is formed into the pipe with protrusions in the forming space.

BRIEF DESCRIPTION OF THE DRAWINGS

FIGS. 3A to 3C are enlarged views of the surroundings of an electrode, in which FIG. 3A is a diagram showing a state where the electrode holds a forming material, FIG. 3B is a diagram showing a state where a seal member is in contact with the electrode, and FIG. 3C is a front view of the electrode.

DETAILED DESCRIPTION

Figure 1:
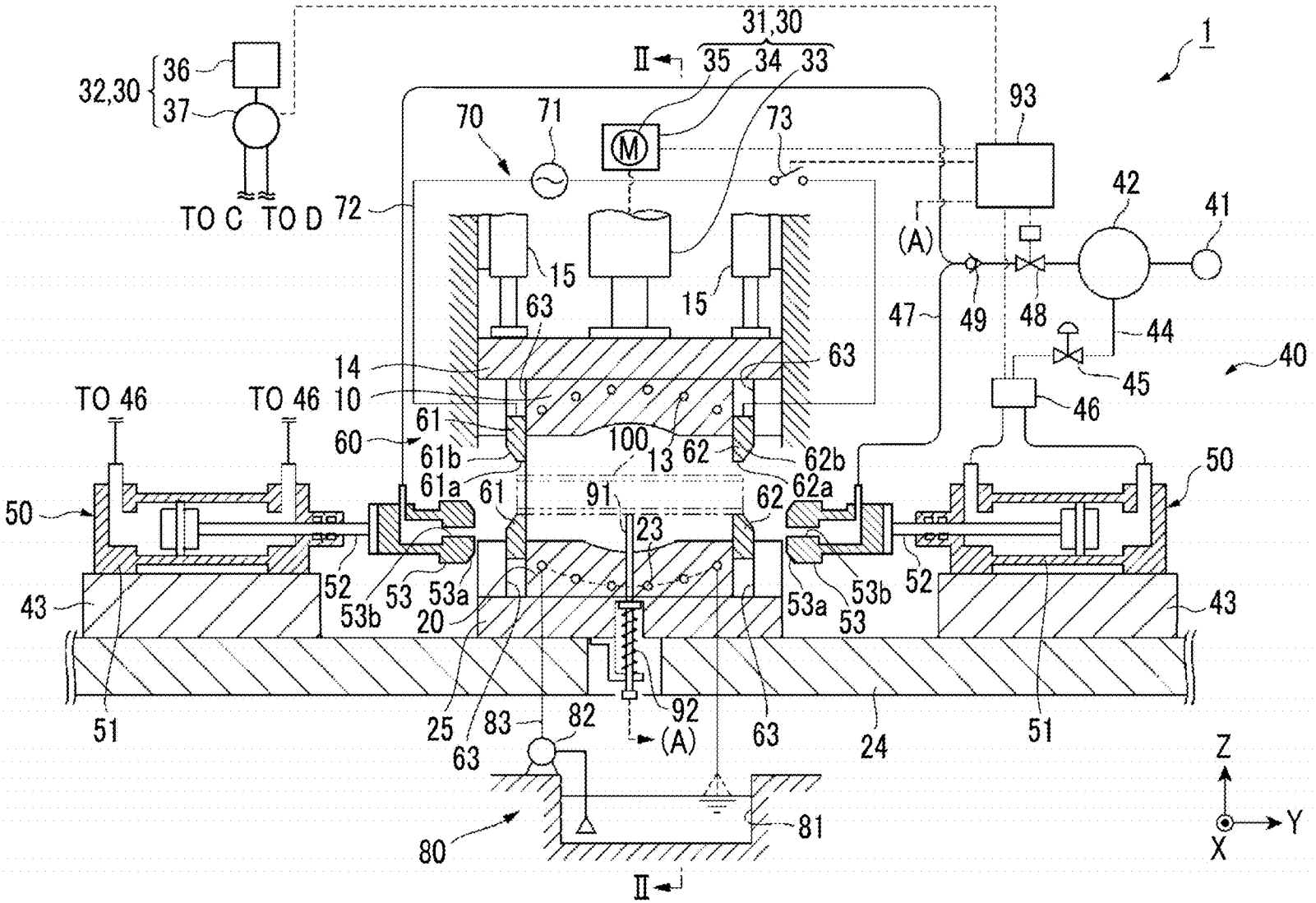
FIG. 1 is a schematic configuration diagram showing a forming apparatus according to an embodiment of the present invention.

In the forming apparatus of the related art as described above, only a soft forming material such as an aluminum alloy can be used. That is, a hard forming material such as iron cannot be used, because it is not possible to secure desired precision. Therefore, a forming apparatus is desired in which a so-called pipe with protrusions, in which protrusions protrude outward from the side surface of a pipe main body, can be easily formed regardless of the type of a forming material.

It is desirable to provide a forming apparatus in which it is possible to easily forma pipe with protrusions, regardless of the type of a forming material.

According to the forming apparatus according to an embodiment of the present invention, the control unit controls the movement of the plurality of dies by the moving mechanism and the gas supply to the forming material by the gas supply unit such that the forming material is formed into the pipe with protrusions in the forming space which is defined between the forming surfaces of the respective dies, and in this way, the forming material expands in the forming space and is pressed against the forming surfaces of the respective dies, and thus the pipe with protrusions is formed. In this manner, a technique of expanding and forming the forming material in the forming space is used, and therefore, it is possible to easily form the pipe with protrusions, regardless of the type of the forming material (more specifically, the hardness or the like of the forming material).

Further, in the forming apparatus according to an embodiment of the present invention, the plurality of dies may include a first upper die, a second upper die movable with respect to the first upper die, a first lower die, and a second lower die movable with respect to the first lower die, at least one of the first upper die and the first lower die may be mounted on a movable slide, and the forming apparatus may further include: a second upper die drive unit which moves the second upper die in a direction which is a direction orthogonal to the axis of the pipe main body and is a direction crossing a direction in which the slide moves; and a second lower die drive unit which moves the second lower die in a direction which is a direction orthogonal to the axis of the pipe main body and is a direction crossing a direction in which the slide moves. In this manner, by moving only the second upper die and the second lower die in a predetermined direction which is a direction orthogonal to the axis of the pipe main body and is a direction crossing a direction in which the slide moves, it is possible to easily form at least three protrusions.

Further, in the forming apparatus according to an embodiment of the present invention, the first upper die and the second upper die, and the first lower die and the second lower die may be disposed point-symmetrically with respect to the axis of the pipe main body. According to this, the first upper die and the second upper die, and the first lower die and the second lower die can be made to be common, so that a reduction in cost can be realized.

According to the present invention, it is possible to easily form a pipe with protrusions, regardless of the type of a forming material.

Hereinafter, a preferred embodiment of a forming apparatus according to the present invention will be described with reference to the drawings.

[Configuration of Forming Apparatus]

Figure 5:
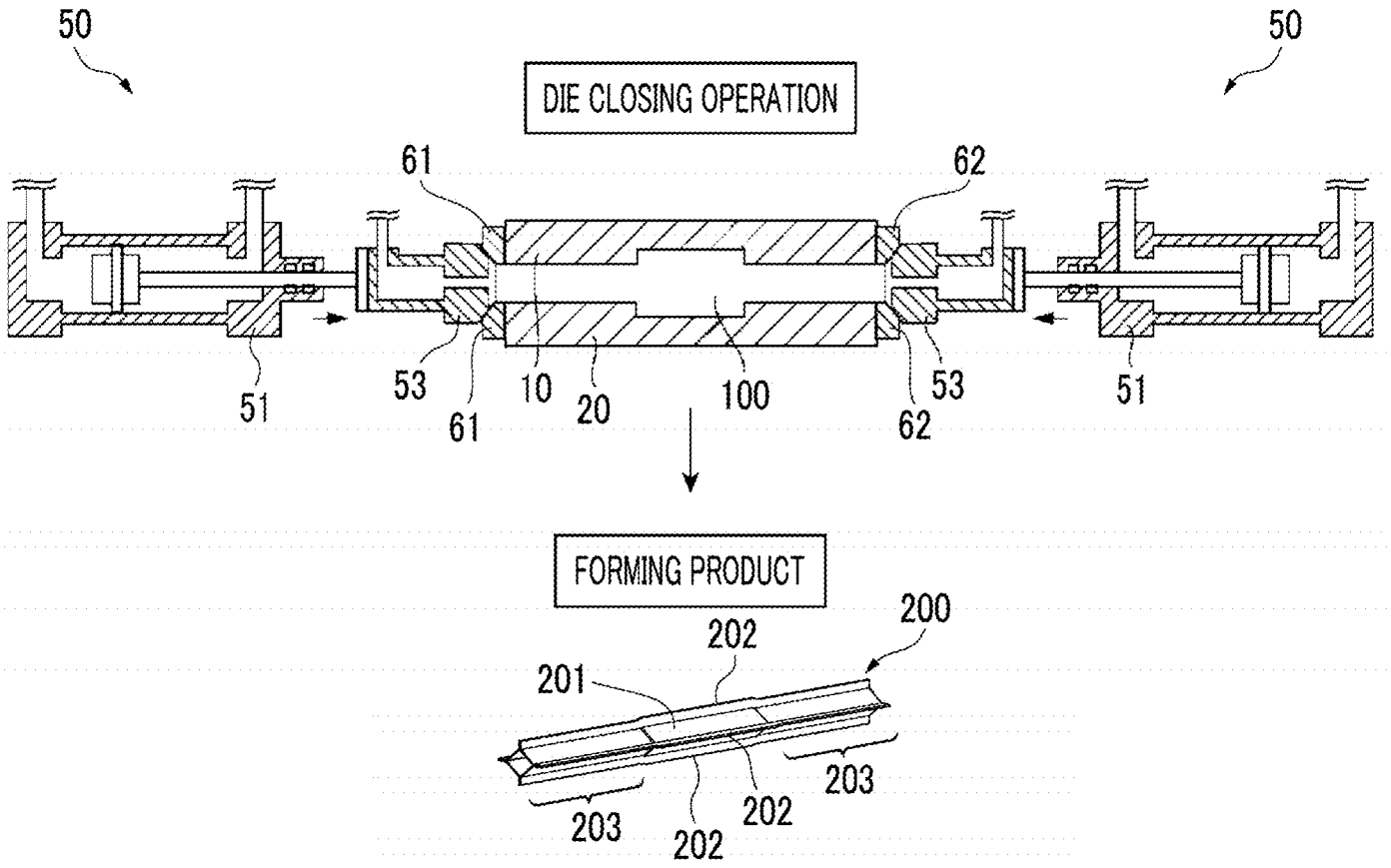
FIG. 5 is a diagram showing a manufacturing step subsequent to FIG. 4.

FIG. 1 is a schematic configuration diagram of a forming apparatus, and this forming apparatus is an apparatus for forming a pipe with protrusions 200 from a forming material 100, as shown in FIG. 5. The formed pipe with protrusions 200 has a pipe main body 201 having a tubular shape (in this example, a rectangular tube shape with a rectangular cross section), protrusions 202, each of which protrudes outward from the outer surface (in this example, a corner portion formed by the outer surfaces adjacent to each other) of the pipe main body 201 and extends in a direction parallel to an axis O (refer to FIG. 12) of the pipe main body 201, and both end portions 203. Both end portions 203 are cut as unnecessary portions in a post-process.

As shown in FIG. 1, a forming apparatus 1 is provided with an upper die (die) 10, a lower die (die) 20, a moving mechanism 30, a gas supply unit 40, a pipe holding mechanism 60, a heating mechanism 70, and a water circulation mechanism 80. The moving mechanism 30 moves the upper die 10 and the lower die 20 such that a forming space for forming the pipe with protrusions 200 is defined between the forming surfaces of the upper die 10 and the lower die 20. The gas supply unit 40 supplies gas to a forming material 100, which is the base of the pipe with protrusions 200, to expand the forming material 100. The pipe holding mechanism 60 holds the forming material 100 so as to be able to move up and down in an up-down direction. The heating mechanism 70 energizes and heats the forming material 100 held by the pipe holding mechanism 60. The water circulation mechanism 80 forcibly water-cools the upper die 10 and the lower die 20 through cooling water passages 13 and 23 formed in the upper die 10 and the lower die 20.

Figure 2:
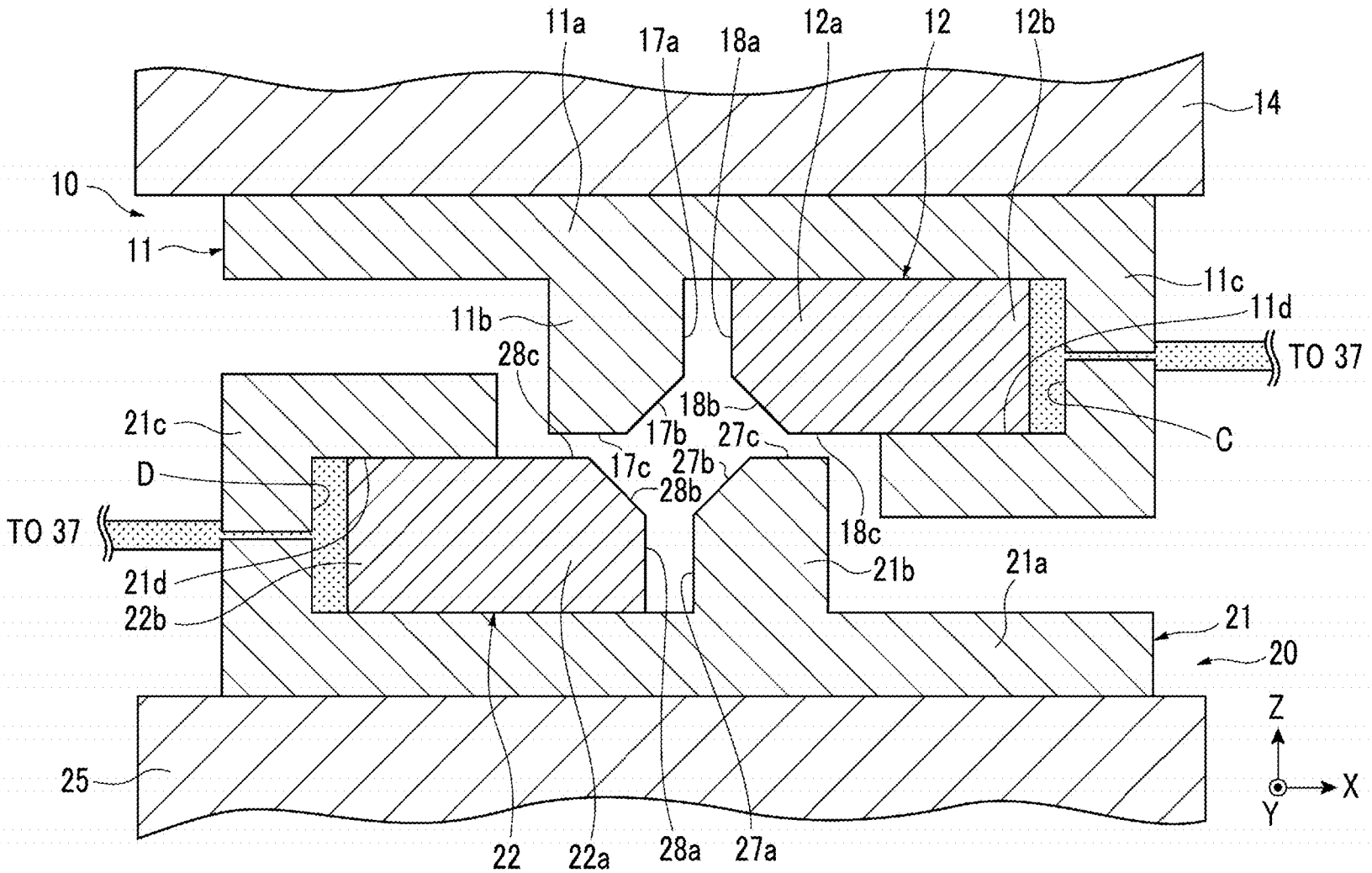
FIG. 2 is a transverse sectional view of a die taken along line II-II in FIG. 1.

FIG. 2 is a transverse sectional view of the die taken along line II-II in FIG. 1. The upper die 10 has a first upper die 11 and a second upper die 12, as shown in FIG. 2. The lower die 20 has a first lower die 21 and a second lower die 22. In this embodiment, the first upper die 11 and the first lower die 21 are of the same type. Further, the second upper die 12 and the second lower die 22 are of the same type. The first upper die 11 and the second upper die 12, and the first lower die 21 and the second lower die 22 are disposed point-symmetrically with respect to the axis O (refer to FIGS. 11 and 12) of the pipe main body 201 shown in FIG. 5.

Returning to FIG. 2 again, the first upper die 11 is fixed to the lower surface of a slide 14. The slide 14 is guided by a guide cylinder 15 so as not to roll, as shown in FIG. 1. The slide 14 is suspended by a pressurizing cylinder 33 and is movable in the up-down direction (hereinafter referred to as a "Z direction").

The first upper die 11 has a plate-shaped base 11*a* fixed to the lower surface of the slide 14, a forming portion 11*b* protruding downward from the base 11*a* at substantially the center, and a supporting portion 11*c* protruding downward from a right end portion in the drawing of the base 11*a* and accommodating and supporting the second upper die 12 so as to be movable in a right-left direction in the drawing, as shown in FIG. 2. The base 11*a*, the forming portion 11*b*, and the supporting portion 11*c* are integrally formed of steel or the like. The first upper die 11 may be indirectly mounted on the slide 14 through, for example, a holder or the like.

The forming portion 11*b* extends in a direction parallel to the axis O of the pipe main body 201 (hereinafter referred to as a "Y direction"). The forming portion 11*b* has forming surfaces 17*a*, 17*b*, and 17*c* corresponding to the outer surfaces of the pipe with protrusions 200. The forming surfaces 17*a*, 17*b*, and 17*c* are continuous with each other, and the forming surface 17*a*, the forming surface 17*b*, and the forming surface 17*c* are arranged in order from the top. The forming surface 17*a* is a surface parallel to the Z direction, the forming surface 17*c* is a surface parallel to a right-left direction (hereinafter referred to as an "X direction") out of the directions orthogonal to the axis O of the pipe main body 201, and the forming surface 17*b* is an inclined surface connected to the forming surfaces 17*a* and 17*c*.

Then, a recess 11*d* having a concave shape is formed by the base 11*a* and the supporting portion 11*c*. An end on one side (an end on the left side in FIG. 2) in the X direction of the recess 11*d* is open and extends in the Y direction. Therefore, the recess 11*d* is located such that the open end faces the forming surfaces 17*a* and 17*b* of the forming portion 11*b*.

The second upper die 12 is accommodated in the recess 11*d* of the first upper die 11 and supported so as to be slidable in the X direction. That is, the second upper die 12 is supported by the first upper die 11. A leading end portion 12*a* of the second upper die 12 is located on the open end side of the recess 11*d*, and a rear end portion 12*b* of the second upper die 12 is located on the bottom side of the recess 11*d*.

The leading end portion 12*a* of the second upper die 12 has forming surfaces 18*a*, 18*b*, and 18*c* corresponding to the outer surfaces of the pipe with protrusions 200. The forming surfaces 18*a*, 18*b*, and 18*c* are continuous with each other, and the forming surface 18*a*, the forming surface 18*b*, and the forming surface 18*c* are arranged in order from the top. The forming surface 18*a* is a surface parallel to the Z direction, the forming surface 18*c* is a surface parallel to the X direction, and the forming surface 18*b* is an inclined surface connected to the forming surfaces 18*a* and 18*c*. The forming surfaces 18*a*, 18*b*, and 18*c* and the forming surfaces 17*a*, 17*b*, and 17*c* are line-symmetrical with respect to an imaginary line parallel to the Z direction.

A first space C is formed between the rear end portion 12*b* of the second upper die 12 and the bottom side of the recess 11*d*. A working fluid is supplied from a fluid tank 36 (refer to FIG. 1) (described later) to the first space C. Here, the working fluid is regarded as a hydraulic oil. However, other working fluids may be used. The first space C is hermetically sealed to the extent that the hydraulic oil does not leak. If the hydraulic oil flows in from the fluid tank 36 (described later), the second upper die 12 moves toward the open end side (the left side in FIG. 2) of the recess 11*d*. On the other hand, if the hydraulic oil flows out from the first space C, the second upper die 12 moves toward the bottom side (the right side in FIG. 2) of the recess 11*d*.

The first lower die 21 is placed on a base 24 (refer to FIG. 1) through a die mounting base 25. In this embodiment, the first lower die 21 does not move in the Z direction. The first lower die 21 has a plate-shaped base 21*a* fixed to the die mounting base 25, a forming portion 21*b* protruding upward from the base 21*a* at substantially the center, and a supporting portion 21*c* protruding upward from a left end portion in the drawing of the base 21*a* and accommodating and supporting the second lower die 22 so as to be movable in the right-left direction in the drawing. The base 21*a*, the forming portion 21*b*, and the supporting portion 21*c* are integrally formed of steel or the like. The first lower die 21 may be indirectly mounted on the die mounting base 25 through, for example, a holder or the like.

The forming portion 21*b* extends in the Y direction and has forming surfaces 27*a*, 27*b*, and 27*c* corresponding to the outer surfaces of the pipe with protrusions 200. The forming surfaces 27*a*, 27*b*, and 27*c* are continuous with each other, and the forming surface 27*a*, the forming surface 27*b*, and the forming surface 27*c* are arranged in order from the bottom. The forming surface 27*a* is a surface parallel to the Z direction, the forming surface 27*c* is a surface parallel to the X direction, and the forming surface 27*b* is an inclined surface connected to the forming surfaces 27*a* and 27*c*. The forming surfaces 27*a*, 27*b*, and 27*c* and the forming surfaces 17*a*, 17*b*, and 17*c* are disposed point-symmetrically with respect to the axis O of the pipe main body 201.

Then, a recess 21*d* having a concave shape is formed by the base 21*a* and the supporting portion 21*c*. The recess 21*d* has a concave shape in which an end on the other side (an end on the right side in FIG. 2) in the X direction is open, and extends in the Y direction. The recess 21*d* is located such that the open end faces the forming surfaces 27*a* and 27*b* of the forming portion 21*b*.

The second lower die 22 is accommodated in the recess 21*d* of the first lower die 21 and supported so as to be slidable in the X direction. That is, the second lower die 22 is supported by the first lower die 21. A leading end portion 22*a* of the second lower die 22 is located on the open end side of the recess 21*d*, and a rear end portion 22*b* of the second lower die 22 is located on the bottom side of the recess 21*d*.

The leading end portion 22*a* of the second lower die 22 has forming surfaces 28*a*, 28*b*, and 28*c* corresponding to the outer surfaces of the pipe with protrusions 200. The forming surfaces 28*a*, 28*b*, and 28*c* are continuous with each other, and the forming surface 28*a*, the forming surface 28*b*, and the forming surface 28*c* are arranged in order from the bottom. The forming surface 28*a* is a surface parallel to the Z direction, the forming surface 28*c* is a surface parallel to the X direction, and the forming surface 28*b* is an inclined surface connected to the forming surfaces 28*a* and 28*c*. The forming surfaces 28*a*, 28*b*, and 28*c* and the forming surfaces 18*a*, 18*b*, and 18*c* are disposed point-symmetrically with respect to the axis O of the pipe main body 201.

A second space D is formed between the rear end portion 22*b* of the second lower die 22 and the bottom side of the recess 21*d*. The hydraulic oil flows in the second space D from the fluid tank 36 (described later). The second space D is hermetically sealed to the extent that the hydraulic oil does not leak. If the hydraulic oil flows in from the fluid tank 36, the second lower die 22 moves toward the open end side (the right side in FIG. 2) of the recess 21*d*. On the other hand, if the hydraulic oil flows out from the second space D, the second lower die 22 moves toward the bottom side (the left side in FIG. 2) of the recess 21*d*.

As shown in FIG. 1, the moving mechanism 30 has a first drive unit 31 which moves the first upper die 11 in the Z direction through the slide 14, and a second drive unit (including a second upper die drive unit and a second lower die drive unit) 32 which moves the second upper die 12 and the second lower die 22 in the right-left direction.

The first drive unit 31 has the pressurizing cylinder 33, a fluid supply unit 34 which supplies the hydraulic oil to the pressurizing cylinder 33, and a servomotor 35 which controls the supply operation of the fluid supply unit 34. The servomotor 35 controls the movement of the slide 14 by controlling the amount of hydraulic oil which is supplied to the pressurizing cylinder 33 by the fluid supply unit 34.

The first drive unit 31 is not limited to a configuration of applying a driving force to the slide 14 through the pressurizing cylinder 33, as described above, and for example, a configuration may also be adopted in which the first drive unit 31 is mechanically connected to the slide 14 and the driving force generated by the servomotor 35 is directly or indirectly applied to the slide 14. For example, it is also possible to adopt a mechanism in which the slide 14 is mounted on an eccentric shaft and the eccentric shaft is rotated by a servomotor or the like. Further, the first drive unit 31 may not be provided with the servomotor 35.

The second drive unit 32 has the fluid tank 36 which accommodates the hydraulic oil, and a fluid pump 37 which allows the hydraulic oil accommodated in the fluid tank 36 to flow in or out of each of the first space C and the second space D. That is, the second drive unit 32 functions as the second upper die drive unit and moves the second upper die 12 in the X direction. Further, the second drive unit 32 functions as the second lower die drive unit and moves the second lower die 22 in the X direction.

The gas supply unit 40 has a pair of gas supply mechanisms 50, a high-pressure gas source 41, and an accumulator 42.

Figure 3A:
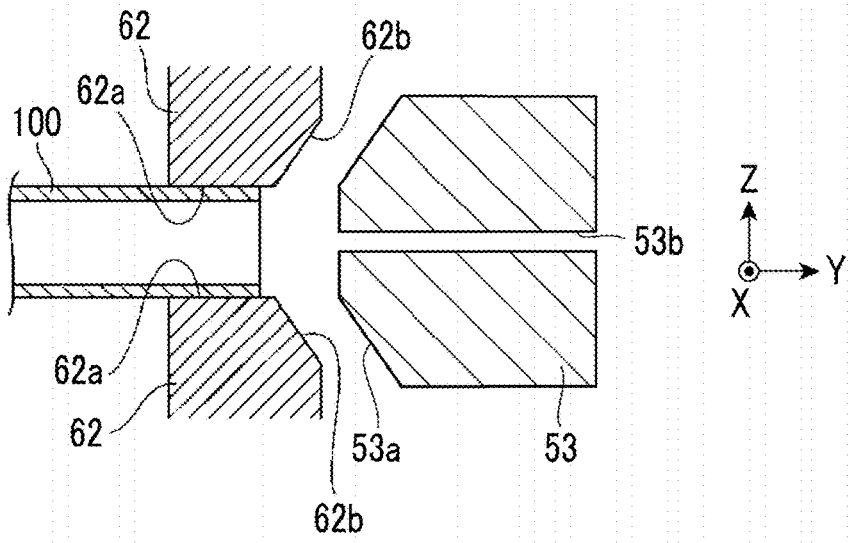
Figure 3B:
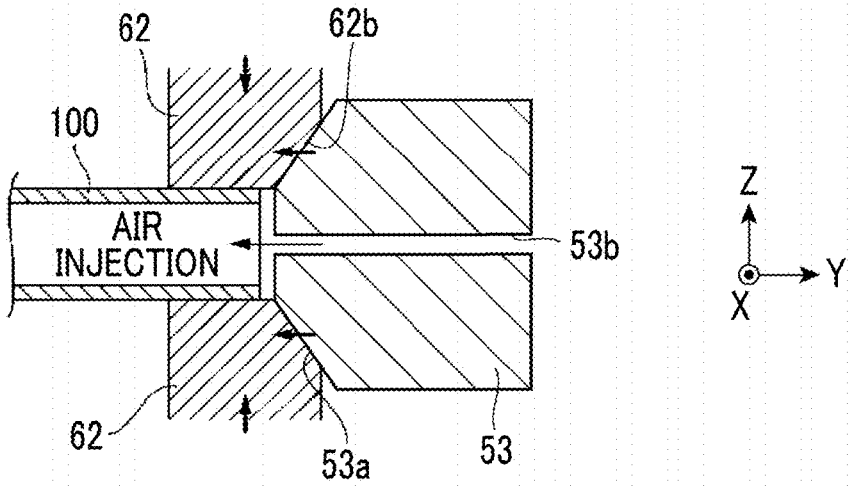

The pair of gas supply mechanisms 50 is respectively disposed on both end sides of the upper die 10 and the lower die 20 in the Y direction. The gas supply mechanism 50 has a cylinder unit 51, a cylinder rod 52, and a seal member 53. The cylinder unit 51 is placed on and fixed to the base 24 through a block 43. The cylinder rod 52 advances and retreats in the Y direction in accordance with the operation of the cylinder unit 51. The seal member 53 is connected to a leading end portion (an end portion on the side of the upper die 10 and the lower die 20) of the cylinder rod 52. A tapered surface 53*a* is formed at the leading end of the seal member 53 such that the leading end has a tapered shape. The tapered surface 53*a* has a shape capable of being exactly fitted to and brought into contact with tapered concave surfaces 61*b* and 62*b* of a first electrode 61 and a second electrode 62, which will be described later. A gas passage 53*b* is provided in the seal member 53. The gas passage 53*b* extends toward the leading end side from the cylinder unit 51 side, and the high-pressure gas supplied from the high-pressure gas source 41 flows through the gas passage 53*b* (refer to FIGS. 3A and 3B).

The high-pressure gas source 41 supplies the high-pressure gas. The accumulator 42 stores the gas supplied by the high-pressure gas source 41. The accumulator 42 and the cylinder unit 51 communicate with each other through a first tube 44. A pressure control valve 45 and a switching valve 46 are interposed in the first tube 44. The accumulator 42 and the gas passage 53*b* in the seal member 53 communicate with each other through a second tube 47. A pressure control valve 48 and a check valve 49 are interposed in the second tube 47. The pressure control valve 45 plays a role of supplying the cylinder unit 51 with gas having an operating pressure adapted to a pushing force of the seal member 53 against the forming material 100. The check valve 49 plays a role of preventing the high-pressure gas from flowing back in the second tube 47.

Figure 3C:
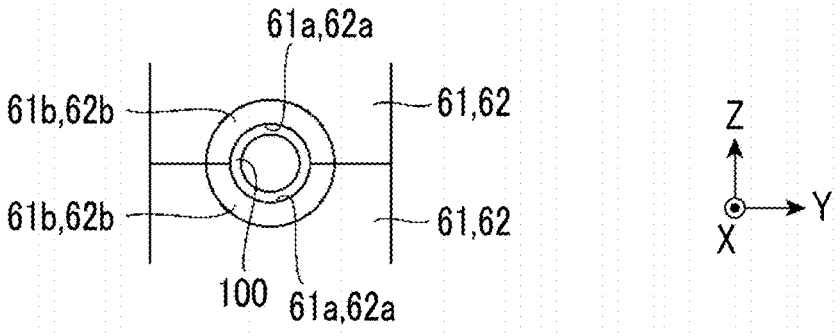

The pipe holding mechanism 60 has a pair of first electrodes 61 and a pair of second electrodes 62. The pair of first electrodes 61 is located so as to face each other in the Z direction on the one end side (the left side in FIG. 1) in the Y direction of the upper die 10 and the lower die 20. The pair of second electrodes 62 is located so as to face each other in the Z direction on the other end side (the right side in FIG. 1) in the Y direction of the upper die 10 and the lower die 20. Semicircular arc-shaped concave grooves 61*a* and 62*a* corresponding to the outer peripheral surface of the forming material 100 are respectively formed in the first electrode 61 and the second electrode 62 (refer to FIG. 3C). The placed forming material 100 is fitted into the concave grooves 61*a* and 62*a*. Further, tapered concave surfaces 61*b* and 62*b* which are recessed to be inclined in a tapered shape are formed in the first electrode 61 and the second electrode 62 so as to be connected to the outer edges of the concave grooves 61*a* and 62*a*. The tapered concave surfaces 61*b* and 62*b* are shaped so as to be fitted to and brought into contact with the tapered surface 53*a* of the seal member 53 (refer to FIG. 3B). Electrode accommodating spaces 63 are provided on both end sides in the Y direction of the upper die 10 and the lower die 20. The first electrode 61 and the second electrode 62 advance and retreat in the Z direction in the electrode accommodating spaces 63 by an actuator (not shown).

The heating mechanism 70 has a power supply 71, a conducting wire 72 extending from the power supply 71 and connected to each of the first electrode 61 and the second electrode 62, and a switch 73 interposed in the conducting wire 72. The heating mechanism 70 heats the forming material 100 to a quenching temperature (a temperature equal to or higher than the AC3 transformation point temperature). In FIG. 1, portions which are connected to the first electrode 61 and the second electrode 62 on the lower die 20 side, of the conducting wire 72, are omitted.

The water circulation mechanism 80 has a water tank 81 for storing water, a water pump 82 for pumping up the water stored in the water tank 81 and pressurizing it to send it to the cooling water passage 13 of the upper die 10 and the cooling water passage 23 of the lower die 20, and a pipe 83. A cooling tower for lowering the water temperature or a filter for purifying the water may be interposed in the pipe 83.

Further, a thermocouple 91 is inserted into a central portion of the lower die 20 from below. The thermocouple 91 measures the temperature of the forming material 100. The thermocouple 91 is supported by a spring 92 so as to be able to move up and down. The thermocouple 91 merely shows one example of temperature measuring means, and a non-contact type temperature sensor such as a radiation thermometer or an optical thermometer may also be used. If the correlation between an energization time and a temperature is obtained, it is also sufficiently possible to make a configuration with the temperature measuring means omitted.

The forming apparatus 1 is provided with a control unit 93. The control unit 93 controls the movement of the first upper die 11, the second upper die 12, and the second lower die 22 by the moving mechanism 30 such that the forming material 100 is formed into the pipe with protrusions 200 in the forming space defined by the forming surfaces 17*a* to 17*c*, 18*a* to 18*c*, 27*a* to 27*c*, and 28*a* to 28*c*. Further, the control unit 93 controls gas supply by the gas supply unit 40. Further, the control unit 93 controls the switch 73, the pressure control valves 45 and 48, and the switching valve 46. Information is transmitted from (A) shown in FIG. 1, whereby the control unit 93 acquires temperature information from the thermocouple 91 and controls each unit. Specific control will be described in the following forming method.

[Method of Forming Pipe with Protrusion]

Next, a method of forming the pipe with protrusions 200 using the forming apparatus 1 will be described.

Figure 4:
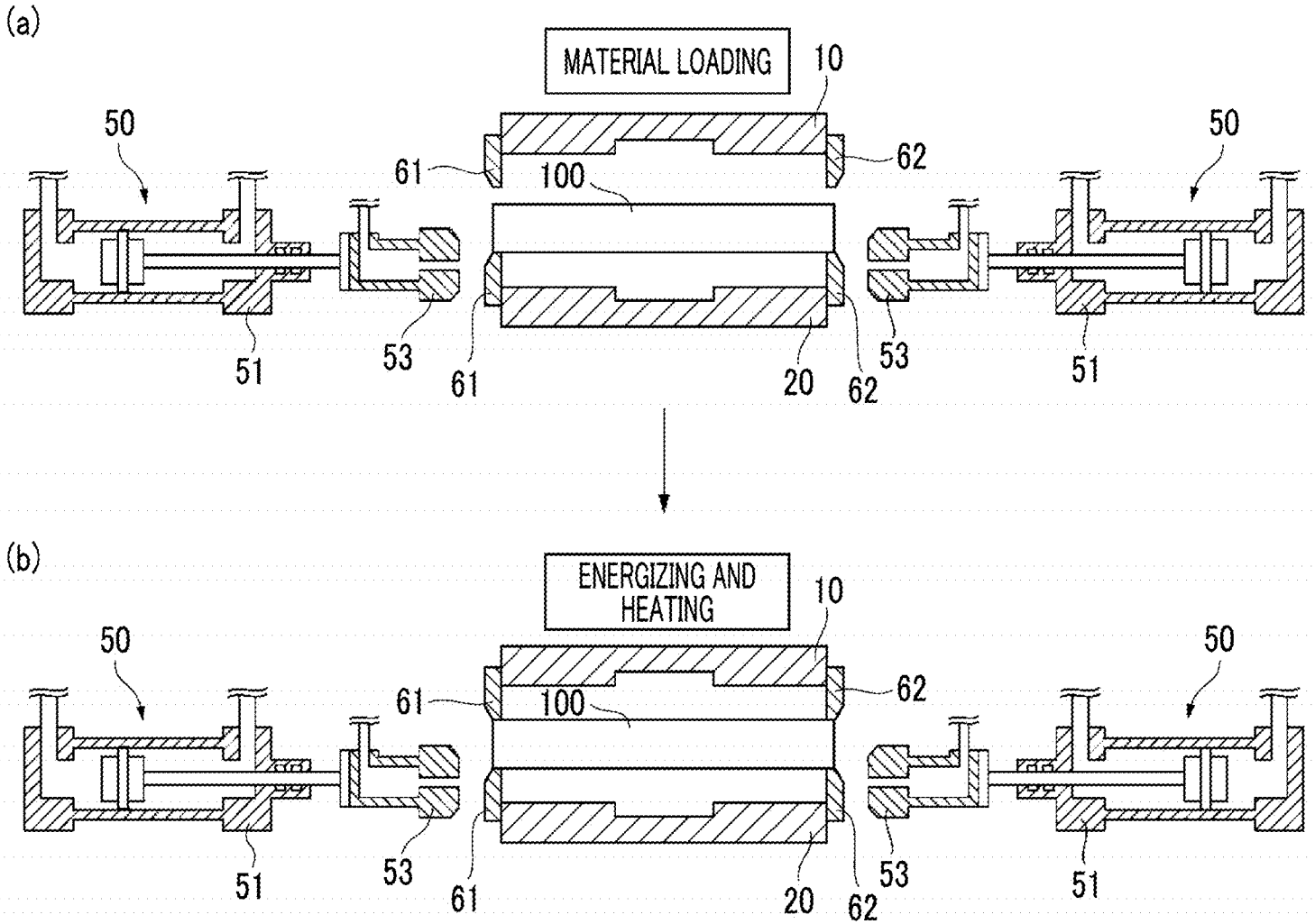
FIG. 4 is a diagram showing a manufacturing step of the forming apparatus, in which (a) is a diagram showing a state where the forming material has been placed into the die and (b) is a diagram showing a state where the forming material is held by electrodes.
Figure 6:
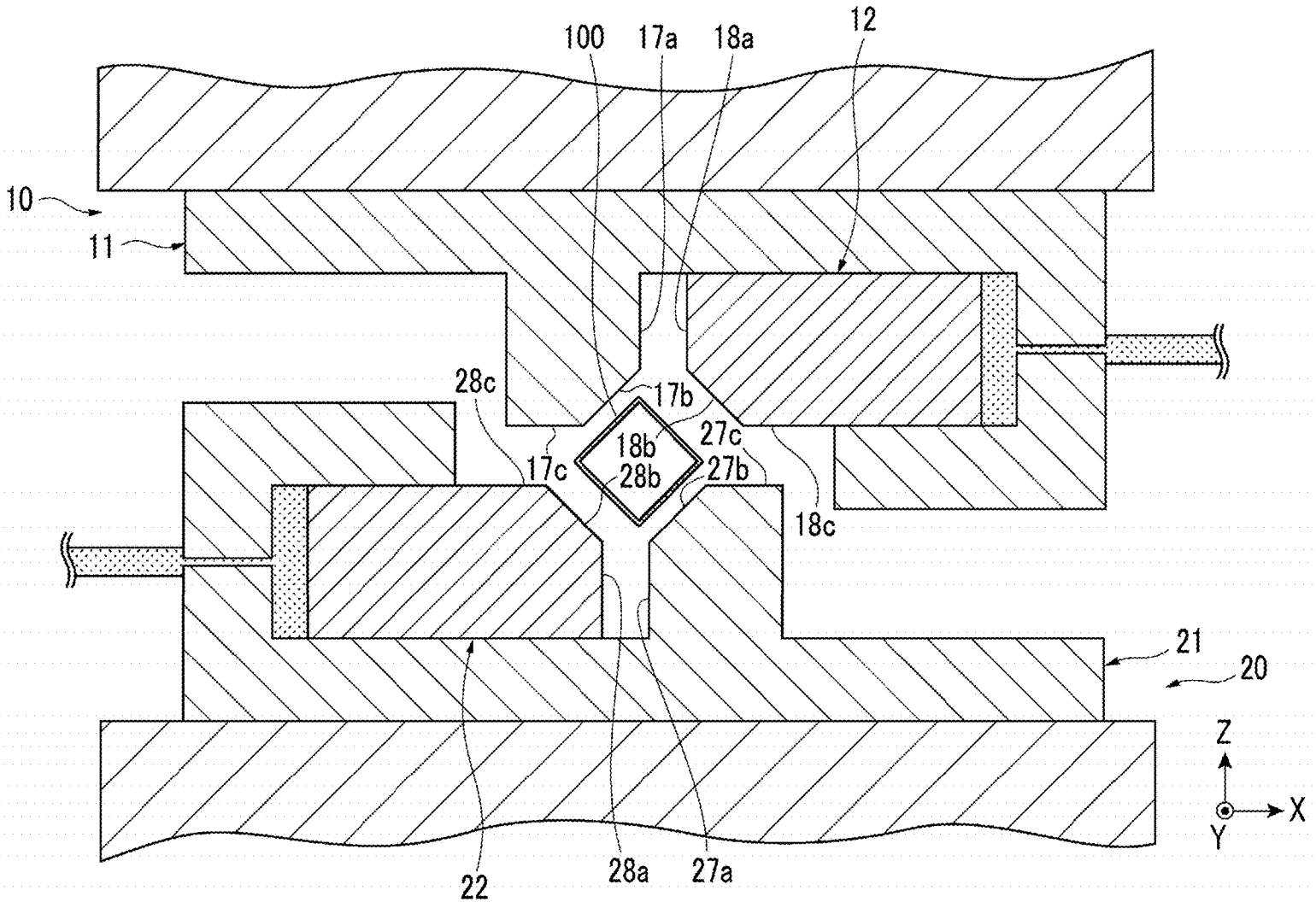
FIG. 6 is a sectional view showing a manufacturing step of the forming apparatus.

First, as shown in (a) of FIG. 4, the forming material 100 having a steel grade capable of being quenched is prepared. The forming material 100 is placed (loaded) on the first electrode 61 and the second electrode 62 which are located on the lower die 20 side by using, for example, a robot arm or the like. Subsequently, the control unit 93 controls the pipe holding mechanism 60 which holds the forming material 100. Specifically, as shown in (b) of FIG. 4, an actuator (not shown) capable of advancing and retreating the first electrode 61 and the second electrode 62 is operated to make the first electrode 61 and the second electrode 62 which are respectively located on the upper and lower sides approach each other. Due to this approach, both end portions of the forming material 100 in the Y direction are gripped by the first electrode 61 and the second electrode 62 from above and below. Further, the gripping is performed in such an aspect as to be in close contact with the forming material 100 over the entire circumference thereof. At this time, the forming material 100 is separated from the forming surfaces 17*a* to 17*c*, 18*a* to 18*c*, 27*a* to 27*c*, and 28*a* to 28*c* of the first upper die 11, the second upper die 12, the first lower die 21, and the second lower die 22, as shown in FIG. 6.

Subsequently, the control unit 93 controls the heating mechanism 70 such that the heating mechanism 70 heats the forming material 100. Specifically, the control unit 93 switches on the switch 73 of the heating mechanism 70. Then, electric power is supplied from the power supply 71 to the forming material 100, and the forming material 100 itself generates heat due to resistance which exists in the forming material 100. At this time, the measurement value of the thermocouple 91 is continuously monitored, and energization is controlled based on the result. Subsequently, the cylinder unit 51 of the gas supply mechanism 50 is operated, whereby both ends of the forming material 100 are sealed with the seal members 53 (refer to FIG. 3B).

Figure 7:
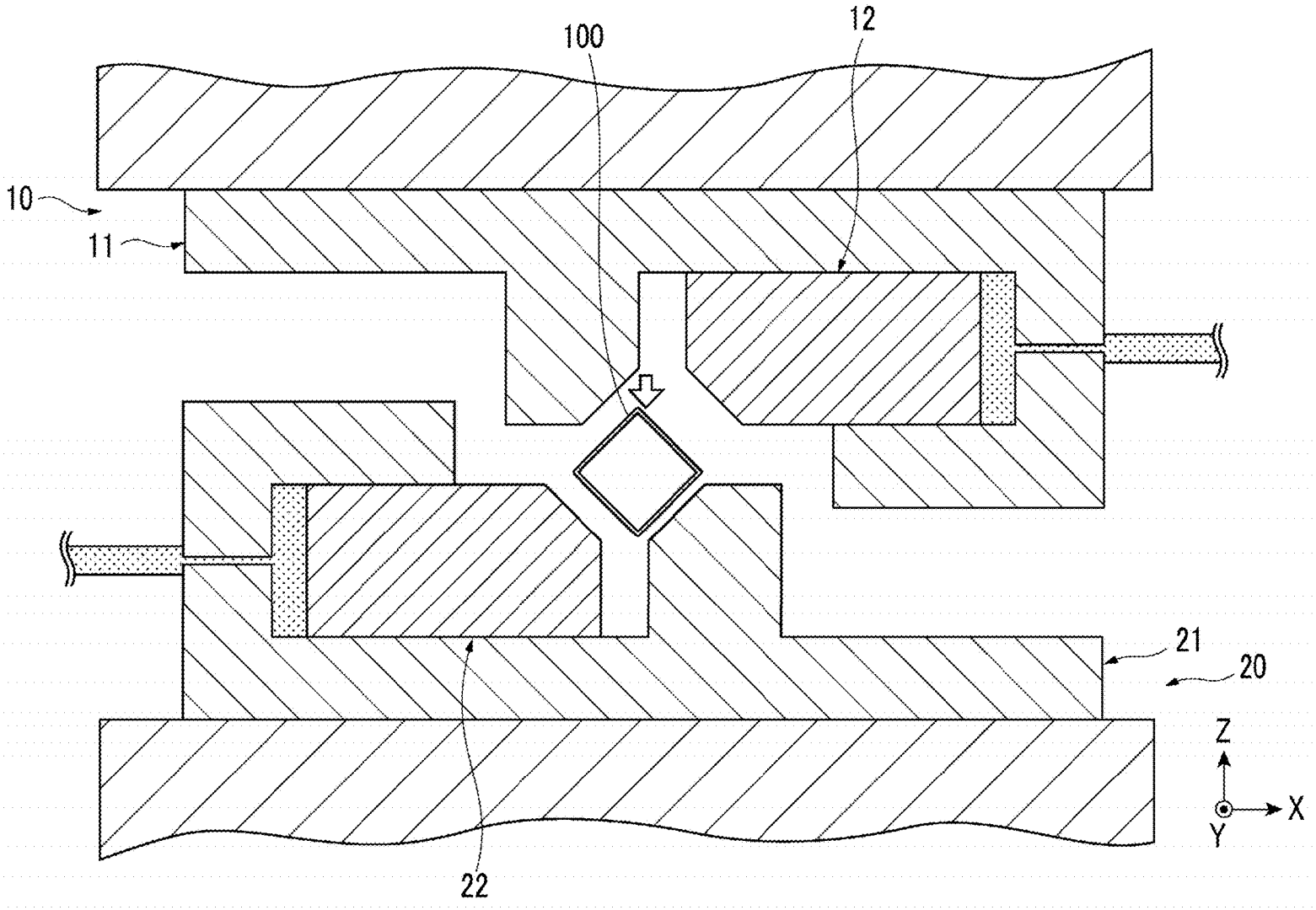
FIG. 7 is a sectional view showing a manufacturing step subsequent to FIG. 6.

Subsequently, the control unit 93 moves the first electrode 61 and the second electrode 62 in a state where the forming material 100 is gripped, such that the forming material 100 moves downward, as shown in FIG. 7.

Figure 8:
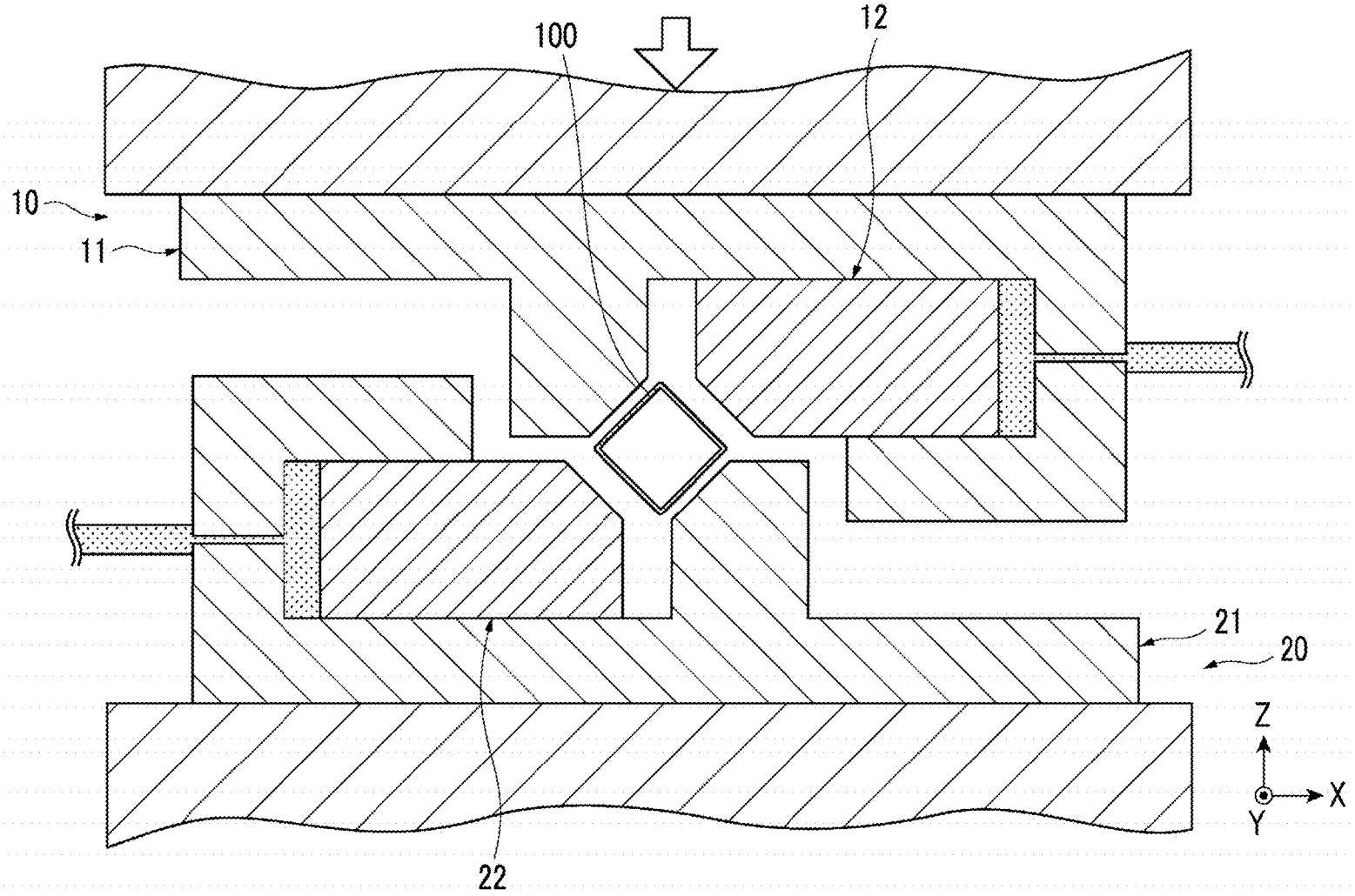
FIG. 8 is a sectional view showing a manufacturing step subsequent to FIG. 7.
Figure 9:
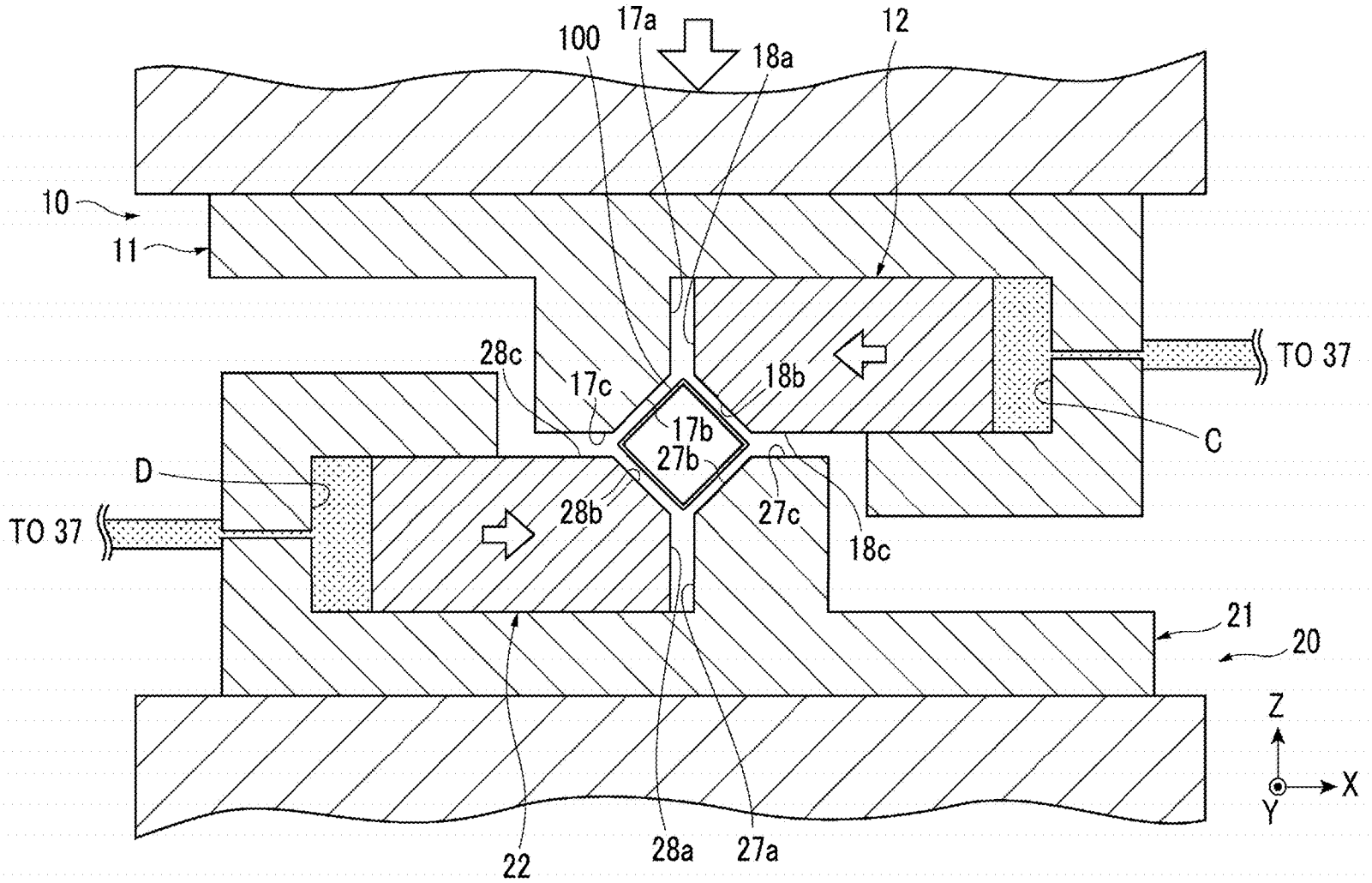
FIG. 9 is a sectional view showing a manufacturing step subsequent to FIG. 8.

Subsequently, the control unit 93 controls the movement of the first upper die 11, the second upper die 12, and the second lower die 22 by the moving mechanism 30 such that the forming material 100 is formed into the pipe with protrusions 200 in the forming space, as shown in FIGS. 8 and 9 (refer to FIG. 5). That is, the control unit 93 executes a first die closing operation. Specifically, the control unit 93 controls the servomotor 35 such that the hydraulic oil is supplied from the fluid supply unit 34 to the pressurizing cylinder 33, as shown in FIG. 8. In this way, the first upper die 11 moves downward through the slide 14. Subsequently, the control unit 93 controls the fluid pump 37 such that the hydraulic oil is supplied to each of the first space C and the second space D, as shown in FIG. 9. In this way, the second upper die 12 moves toward one side (the left side in FIG. 9) in the X direction and the second lower die 22 moves by the same amount toward the other side (the right side in FIG. 9) in the X direction.

With the first die closing operation, a forming space for forming the pipe main body 201 is defined between the forming surfaces 17*b* and 27*b* facing each other and the forming surfaces 18*b* and 28*b* facing each other. Further, a forming space for forming the protrusion 202 is defined between the forming surfaces 17*a* and 18*a* facing each other. Further, a forming space for forming the protrusion 202 is defined between the forming surfaces 17*c* and 28*c* facing each other. Further, a forming space for forming the protrusion 202 is defined between the forming surfaces 27*a* and 28*a* facing each other. Further, a forming space for forming the protrusion 202 is defined between the forming surfaces 18*c* and 27*c* facing each other.

Figure 10:
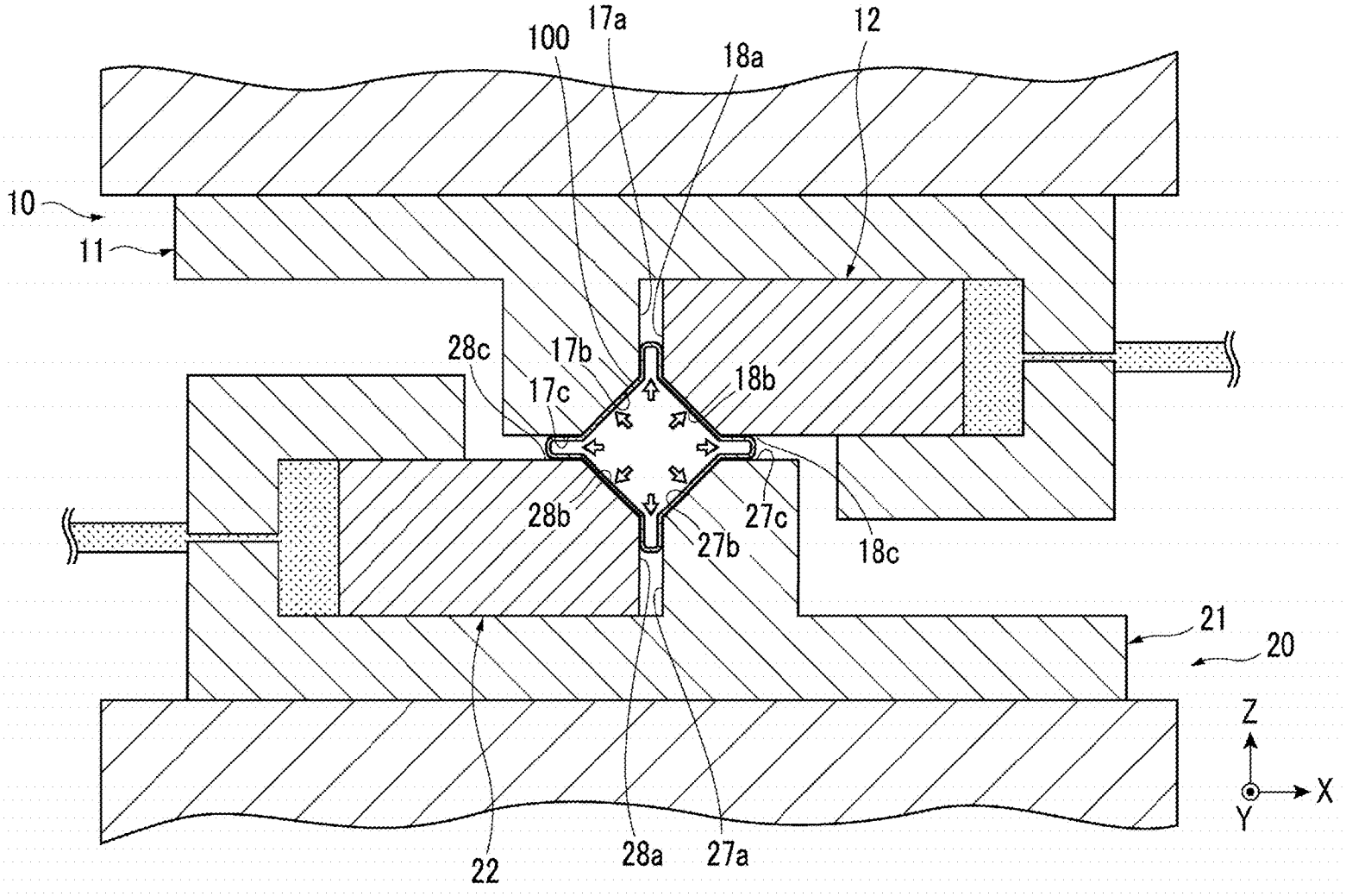
FIG. 10 is a sectional view showing a manufacturing step subsequent to FIG. 9.

Subsequently, the control unit 93 supplies high-pressure gas to the forming material 100 to expand the forming material 100, as shown in FIG. 10. Here, the forming material 100 has been heated to a high temperature (around 950° C.) and softened, and therefore, the gas supplied into the forming material 100 thermally expands. For this reason, for example, the gas to be supplied is set to be compressed air, and thus the forming material 100 having a temperature of 950° C. can be easily expanded by the thermally expanded compressed air. In this way, the forming material 100 expands in the forming space, thereby being pressed against the forming surfaces 17*a* to 17*c*, 18*a* to 18*c*, 27*a* to 27*c* and 28*a* to 28*c*.

Figure 11:
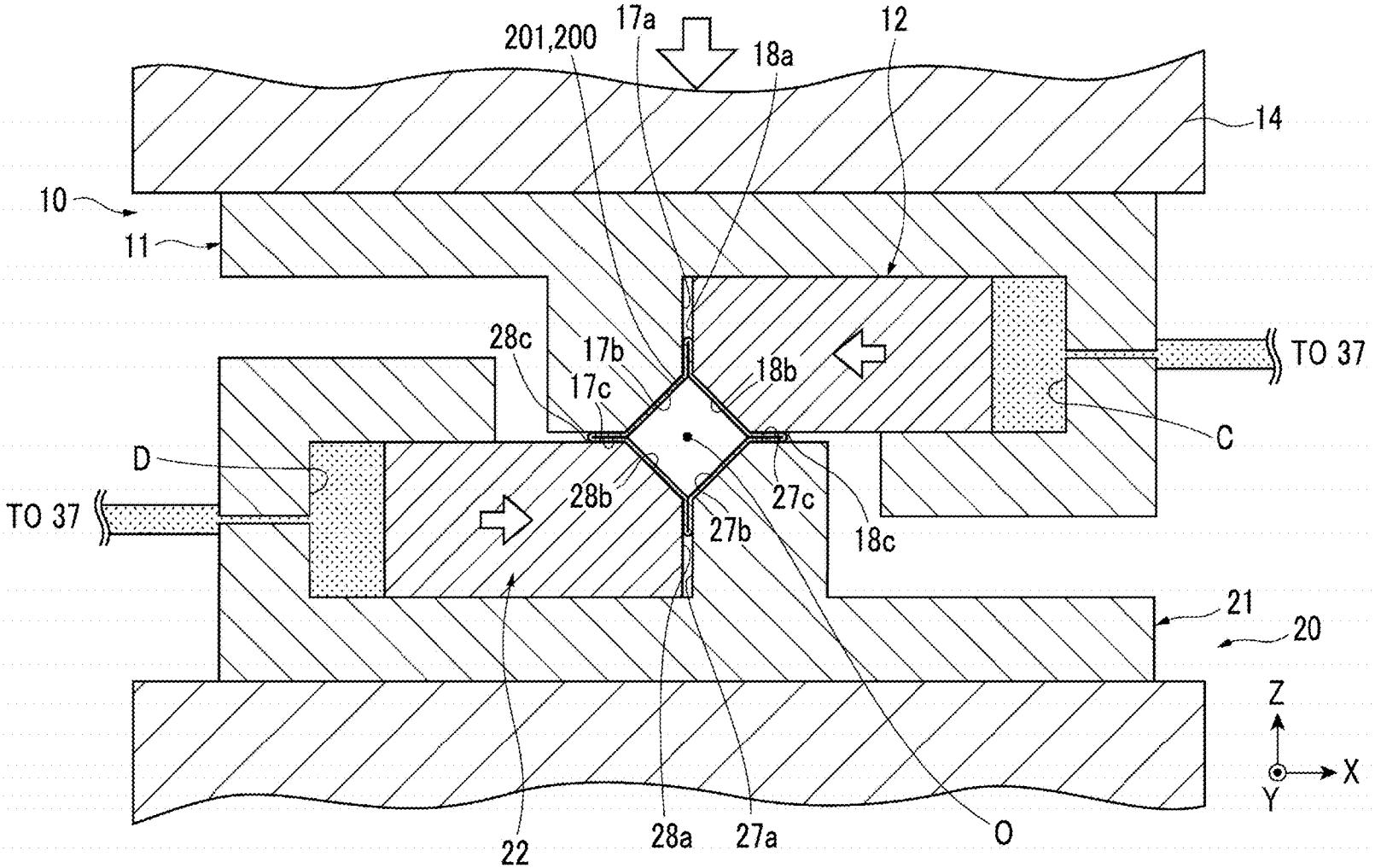
FIG. 11 is a sectional view showing a manufacturing step subsequent to FIG. 10.

Subsequently, the control unit 93 executes a second die closing operation to perform further die closing from the die closing position by the first die closing operation, as shown in FIG. 11. Specifically, the control unit 93 controls the servomotor 35 such that the first upper die 11 moves further downward through the slide 14, and the control unit 93 also controls the fluid pump 37 such that the second upper die 12 further moves toward one side (the left side in FIG. 11) in the X direction and the second lower die 22 further moves by the same amount toward the other side (the right side in FIG. 11) in the X direction.

In this way, the forming material 100 softened by the heating and supplied with the high-pressure gas is formed into the pipe with protrusions 200 in the forming space. That is, the forming material 100 is formed into the pipe main body 201 having a rectangular cross section fitted to the rectangular cross section of the forming space, and the protrusions 202 in which the forming material 100 is partially folded (refer to FIG. 5).

Figure 12:
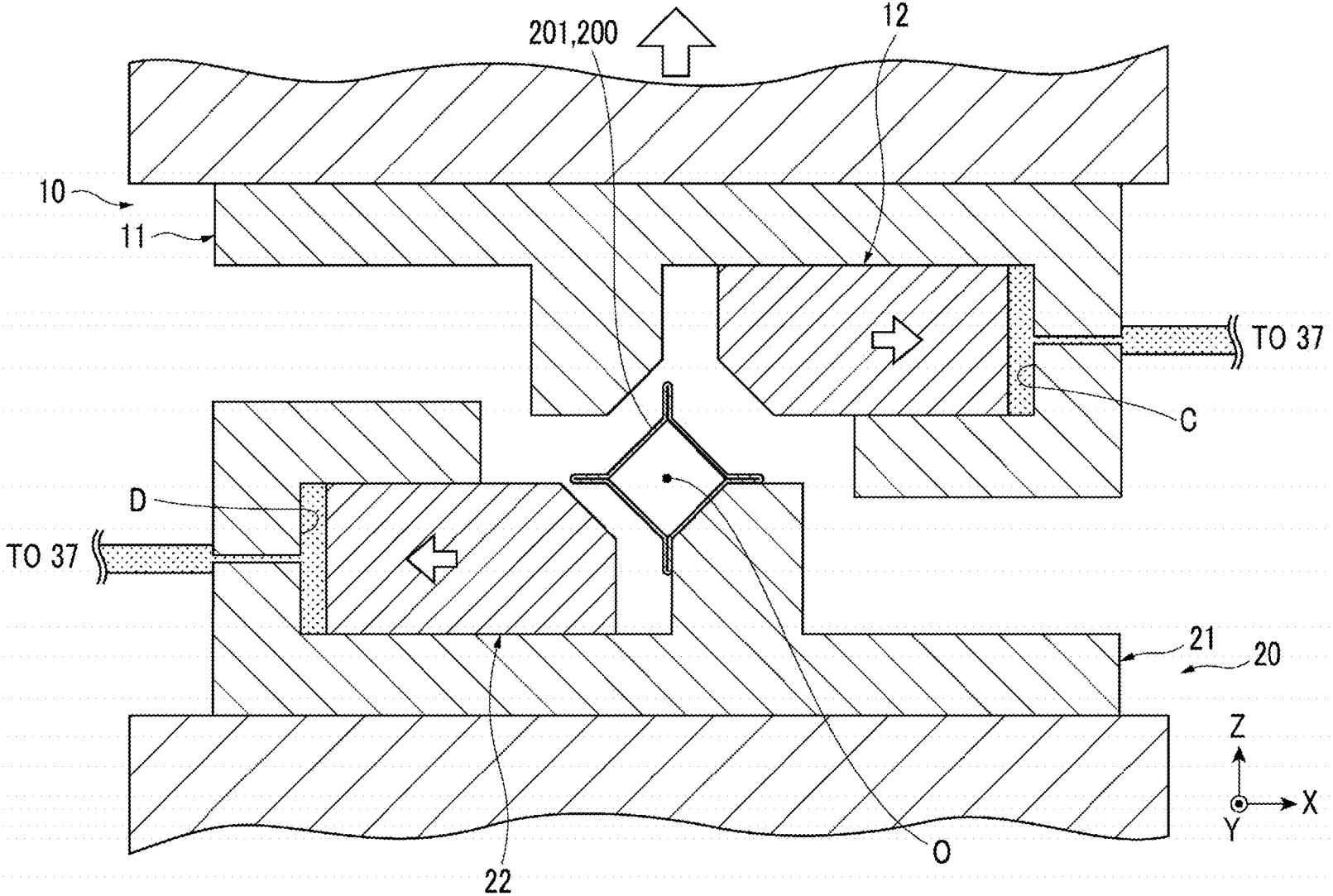
FIG. 12 is a sectional view showing a manufacturing step subsequent to FIG. 11.

Subsequently, the control unit 93 executes a die opening operation, as shown in FIG. 12. Specifically, the control unit 93 controls the fluid pump 37 such that the hydraulic oil flows out from each of the first space C and the second space D. In this way, the second upper die 12 moves to the other side (the right side in FIG. 12) in the X direction and the second lower die 22 moves to one side (the left side in FIG. 12) in the X direction. The control unit 93 controls the servomotor 35 such that the hydraulic oil is recovered from the pressurizing cylinder 33 to the fluid supply unit 34. In this way, the first upper die 11 moves upward through the slide 14.

Subsequently, the control unit 93 controls the pipe holding mechanism 60 such that the pipe with protrusions 200 is lifted upward. In this way, a state is created where the pipe with protrusions 200 can be recovered.

With the forming method as described above, it is possible to obtain the pipe with protrusions 200 as a forming product, as shown in FIG. 5.

At the time of this forming, the outer peripheral surface of the formed and expanded forming material 100 is rapidly cooled in contact with the lower die 20 and at the same time, is rapidly cooled in contact with the upper die 10 (since the upper die 10 and the lower die 20 have large heat capacity and are controlled to a low temperature, if the forming material 100 comes into contact with the upper die 10 and the lower die 20, the heat of the material surface is removed to the die side at once), and thus quenching is performed. Such a cooling method is called die contact cooling or die cooling. Immediately after the forming material is rapidly cooled, austenite is transformed into martensite (hereinafter, the transformation of austenite to martensite is referred to as martensitic transformation). Since a cooling rate is reduced in the second half of the cooling, the martensite is transformed into another structure (troostite, sorbite, or the like) due to reheating. Therefore, it is not necessary to separately perform tempering treatment. Further, in this embodiment, instead of the die cooling or in addition to the die cooling, cooling may be performed by supplying a cooling medium to the forming material 100. For example, the martensitic transformation may be generated by performing cooling by bringing the forming material 100 into contact with the die to a temperature at which the martensitic transformation begins, and then opening the die and blowing a cooling medium (cooling gas) to the forming material 100.

As described above, according to the forming apparatus 1, the control unit 93 controls the movement of the upper die 10 and the lower die 20 by the moving mechanism 30 and the gas supply by the gas supply unit 40 such that the forming material 100 is formed into the pipe with protrusions 200 in the forming space defined between the forming surfaces 17*a* to 17*c*, 18*a* to 18*c*, 27*a* to 27*c*, and 28*a* to 28*c* of the first upper die 11, the second upper die 12, the first lower die 21, and the second lower die 22, and in this way, the forming material 100 expands in the forming space and is pressed against the forming surfaces 17*a* to 17*c*, 18*a* to 18*c*, 27*a* to 27*c*, and 28*a* to 28*c*, and thus the pipe with protrusions 200 is formed. In this manner, a technique of expanding and forming the forming material 100 in the forming space is used, and therefore, it is possible to easily form the pipe with protrusions 200, regardless of the type of the forming material 100 (more specifically, the hardness or the like of the forming material 100).

Further, the upper die 10 and the lower die 20 have the first upper die 11, the second upper die 12 movably supported by the first upper die 11, the first lower die 21, and the second lower die 22 movably supported by the first lower die 21, the first upper die 11 is movable in the Z direction, and the second upper die 12 and the second lower die 22 are movable in the X direction. In this manner, by moving only the second upper die 12 and the second lower die 22 in the X direction, it is possible to easily form at least three protrusions 202. Further, in a case of moving the first upper die 11 and the second upper die 12 in the Z direction, it is not necessary to provide a moving mechanism for independently moving the second upper die 12 in the Z direction. Similarly, in a case of moving the first lower die 21 and the second lower die 22 in the Z direction, it is not necessary to provide a moving mechanism for independently moving the second lower die 22 in the Z direction. Further, due to moving only the second upper die 12 and the second lower die 22 in the X direction, it is not necessary to provide a moving mechanism for moving the first upper die 11 and the first lower die 21 in the X direction. Therefore, it is possible to simplify the moving mechanism 30.

Further, the first upper die 11 and the second upper die 12, and the first lower die 21 and the second lower die 22 are disposed point-symmetrically with respect to the axis O of the pipe main body 201, and therefore, the first upper die 11 and the second upper die 12, and the first lower die 21 and the second lower die 22 can be made to be common, and thus a reduction in cost can be realized.

The preferred embodiment of the present invention has been describe above. However, the present invention is not limited to the above embodiment at all. For example, the forming apparatus 1 may not necessarily have the heating mechanism 70, and the forming material 100 may be heated in advance.

Further, in the above embodiment, since the second upper die 12 is supported by the first upper die 11 and the second lower die 22 is supported by the first lower die 21, it is not necessary to provide a moving mechanism for independently moving the second upper die 12 and the second lower die 22 in the Z direction. However, for example, the second upper die 12 and the second lower die 22 are not supported by the first upper die 11 and the first lower die 21, and instead, a moving mechanism for independently moving the second upper die 12 and the second lower die 22 In the Z direction may be provided. In this case, the moving mechanism moves the second upper die 12 and the second lower die 22 in the Z direction, and the second drive unit 32 moves the second upper die 12 and the second lower die 22 in the X direction. Further, such drive sources (including the second drive unit 32) of the second upper die 12 and the second lower die 22 may not be hydraulic pressure but may be other systems (an electric cylinder, a ball screw, or the like).

Further, in the above embodiment, the first upper die 11 is made to be movable in the Z direction. However, it is acceptable if at least one of the first upper die 11 and the first lower die 21 is movable in the Z direction. Therefore, in addition to the first upper die 11 or instead of the first upper die 11, the first lower die 21 may move in the Z direction. Further, the direction of movement of the first upper die 11 and the first lower die 21 may not be strictly the Z direction but may be a direction tilted from the Z direction.

Further, in the above embodiment, the second drive unit 32 moves the second upper die 12 in the X direction. However, there is no limitation thereto, and the second upper die 12 may be moved in a direction which is a direction orthogonal to the axis O of the pipe main body 201 and is a direction crossing the direction in which the slide 14 moves.

Further, in the above embodiment, the first lower die 21 does not move in the Z direction. However, there is no limitation thereto, and the first lower die 21 may be moved by making, for example, the die mounting base 25 function as a slide.

Further, in a case where the first lower die 21 does not move, the second drive unit 32 may move the second lower die 22 in a direction which is a direction orthogonal to the axis O of the pipe main body 201 and is a direction crossing the direction in which the slide 14 moves. Further, in a case where the first lower die 21 moves, the second drive unit 32 may move the second lower die 22 in a direction which is a direction orthogonal to the axis O of the pipe main body 201 and is a direction crossing the direction in which the die mounting base 25 in a case of making the die mounting base 25 function as a slide moves.

Further, the pipe main body 201 may be an angular pipe main body having a cross section of a polygonal shape other than a rectangular shape, such as a triangular shape, a pentagonal shape, or the like, or may be a round pipe main body having a circular cross-sectional shape.

Further, in the above embodiment, the protrusions 202 protrude from all the corner portions of the pipe main body 201. However, it is acceptable if the protrusion 202 protrudes from at least one of the corner portions. Further, the protrusion 202 may protrude outward from the outer surface other than the corner portion. Further, the cross-sectional shape of the forming material 100 may be any shape such as a rectangle, a triangle, a pentagon, a circle, an ellipse, or the like.

The number, the shapes, or the like of the dies may be appropriately changed in accordance with the design conditions described above. In this embodiment, the number of dies is set to be four. However, it is acceptable if the number of dies is three or more (for example, a state where either the second upper die 12 or the second lower die 22 does not exist).

Further, the forming apparatus 1 is provided with the first upper die 11, the second upper die 12, the first lower die 21, and the second lower die 22. However, instead of these, the forming apparatus 1 may be provided with an upper die and a lower die facing each other in the Z direction, and a pair of side dies which are located laterally between the upper die and the lower die in the Z direction and face each other in the X direction. In this case, at least one of the upper die and the lower die moves only in the Z direction and at least one of the pair of side dies moves only in the X direction, whereby it is possible to easily form a protrusion on the outer surface.

It should be understood that the invention is not limited to the above-described embodiment, but may be modified into various forms on the basis of the spirit of the invention. Additionally, the modifications are included in the scope of the invention.

What is claimed is:

1. A forming apparatus that forms a pipe with flanges having a tubular pipe main body and flanges protruding outward from an outer surface of the pipe main body and extending in a direction parallel to an axis of the pipe main body, the forming apparatus comprising:

a plurality of dies composed of at least three dies having forming surfaces corresponding to the outer surfaces of the pipe with flanges;

a moving mechanism configured to move the plurality of dies such that a forming space for forming the pipe with flanges is defined between the forming surfaces of the plurality of dies;

a slide configured to be movable in a predetermined direction by the moving mechanism;

a heating mechanism configured to heat a forming material which is a base of the pipe with flanges; and a gas supply unit configured to supply gas to the heated forming material to expand the heated forming material, wherein:

the plurality of dies includes a first upper die, a second upper die is movable with respect to the first upper die and a first lower die, the slide is movable in a direction in which the first upper die approaches and separates from the first lower die, the first upper die is mounted on the slide, the moving mechanism includes a drive unit that moves the second upper die in a direction which is orthogonal to the axis of the pipe main body and crosses a direction in which the slide moves, and the pipe with flanges includes at least three flanges, and the flanges are formed by partially folding the forming material such that portions of an inner surface of the forming material come into contact with each other.

2. The forming apparatus according to claim 1, further comprising:

a control unit configured to perform a first die closing operation and a second die closing operation, wherein:

the first die closing operation is an operation in which the control unit controls movement of the first upper die, the second upper die and a second lower die by the moving mechanism such that the forming space for forming the pipe main body and the flanges is defined between the forming surfaces, and the second die operation is an operation in which the control unit controls movement of the first upper die, the second upper die and the second lower die by the moving mechanism such that the expanded forming material is partially folded and the pipe with flanges is formed.

3. The forming apparatus according to claim 1, further comprising:

a die mounting base, wherein:

the die mounting base serves as the slide, and the first lower die is movable toward the first upper die in a state where the first lower die is mounted on the die mounting base.

4. The forming apparatus according to claim 1, wherein the forming portion of the first upper die protrudes from the first upper die.

5. The forming apparatus according to claim 1, wherein the forming space comprises a space between a forming surface of the first lower die and a forming surface of the first upper die.

6. The forming apparatus according to claim 1, wherein the forming space comprises a space between a forming surface of the first upper die and a forming surface of the second upper die.

7. The forming apparatus according to claim 1, wherein the die drive unit supplies a fluid into a recess of the first upper die in a manner that causes a movement of the second upper die.

8. The forming apparatus according to claim 7, wherein the second upper die drive unit is controllable in a manner that causes the movement of the second upper die to move the second upper die toward the forming portion of the first upper die.

9. The forming apparatus according to claim 1, further comprising:

a second lower die, the second lower die is accommodated in a recess of the first lower die in a manner that permits the second lower die to be movable toward a forming portion of the first lower die.

10. The forming apparatus according to claim 9, wherein the forming portion of the first lower die protrudes from the first lower die.

11. The forming apparatus according to claim 9, further comprising:

a second lower die drive unit that is configured to supply a fluid into the recess of the first lower die in a manner that causes a movement of the second lower die.

12. The forming apparatus according to claim 11, wherein the second lower die drive unit is controllable in a manner that causes the movement of the second lower die to move the second lower die toward the forming portion of the first lower die.

13. The forming apparatus according to claim 11, wherein the movement of the second lower die is along a direction that is orthogonal to the movement of the slide.

14. The forming apparatus according to claim 11, wherein the movement of the second lower die causes the second lower die to move along a direction orthogonal to the axis of the pipe main body.

15. The forming apparatus according to claim 9, wherein the first upper die and the second upper die, and the first lower die and the second lower die are disposed point-symmetrically with respect to an axis of a pipe main body.

* * * * *